US005337688A

United States Patent [19]

Arima

[11] Patent Number: 5,337,688

[45] Date of Patent: Aug. 16, 1994

[54] LOOPER THREAD HOLDING APPARATUS FOR A SEWING MACHINE AND METHOD OF HOLDING A LOOPER THREAD

[75] Inventor: Katsumi Arima, Higashiosaka, Japan

[73] Assignee: Union Special Japan Ltd., Osaka, Japan

[21] Appl. No.: 76,623

[22] Filed: Jun. 15, 1993

[51] Int. Cl.[5] ..... D05B 65/00

[52] U.S. Cl. ..... 112/298; 112/253; 112/262.1

[58] Field of Search ..... 112/253, 298, 296, 285, 112/291, 292, 293, 295, 262.1

[56] References Cited

U.S. PATENT DOCUMENTS 3,599,588 8/1971 Angele ..... 112/253 X 4,879,960 11/1989 Prais ..... 112/253 X

*Primary Examiner*—Clifford D. Crowder

*Assistant Examiner*—Paul C. Lewis

*Attorney, Agent, or Firm*—William Brinks Hofer Gilson & Lione

[57] ABSTRACT

The apparatus provides: thread hooking means having a thread hooking member for hooking a thread having a predetermined tension, the thread hooking member being disposed in proximity of a moving path of a needle, and for retracting the thread hooking member to a predetermined first refuge position to draw the thread toward the first refuge position; cutting and holding means for cutting the thread drawn toward the first refuge position by the thread hooking means, by the cooperation of one surface of the thread hooking member and a cutting edge which is disposed in proximity of the one surface, and for holding the vicinity of the cut portion of the thread by the cooperation the other surface of the thread hooking member and a holding member which is resiliently pressed against the other surface; and means for, immediately after a sewing operation is started, retracting to a second refuge position separated from the first refuge position, to cancel the held state of the thread hold by the cutting and holding means. Thereby, the end of a looper thread extending from the starting portion of a seam is made as short as possible so that the thread end removal operation after the sewing operation is not required to conduct.

3 Claims, 8 Drawing Sheets

LOOPER THREAD HOLDING APPARATUS FOR A SEWING MACHINE AND METHOD OF HOLDING A LOOPER THREAD

BACKGROUND OF THE INVENTION

1. Field of the Invention

This invention relates to a looper thread holding apparatus for a sewing machine and a method of holding the cut portion of the looper thread using the apparatus which can be suitably applied to a looper sewing machine ]For passing a looped elastic braid through a circular sewn product such as clothes.

2. Description of the Related Art

When an elastic braid is to be sewed on or passed through a cylinder portion 2 of a cloth 1 such as an undergarment shown in FIG. 1 by a looper sewing machine having a plurality of needles, for example, the sewing operation is conducted while rotating the cloth 1 in the direction of an arrow A, under the state where a plurality of looper threads are held by a looper thread holding apparatus disposed inside the bed of the sewing machine. As a result of this sewing operation, a plurality of seams 3 are formed over the circumference along the circumferential direction.

In the related art, the next sewing operation is started under the state where the looper threads are kept held by the looper thread holding apparatus. Therefore, the ends 4 of the looper threads are left extending from the starting portions 3*a* of the seams 3 to form so-called fluff having a length of about 5 to 7 cm. When the ending portions 3*b* of the seams 3 exceed the starting portions 3*a* or the lap seam is conducted, the ends 4 are sewed in the ending portions 3*b*. After the sewing operation, the operator must manually cut away the ends 4 of the looper threads, thereby producing a problem in that this cutting operation requires much labor and a long time.

SUMMARY OF THE INVENTION

Accordingly, it is an object of the invention to provide a looper thread holding apparatus for a sewing machine and a method of holding a looper thread which can reduce as much as possible the amount of fluff formed by the ends 4 of the looper threads so that the thread end removal operation after the sewing operation is not required The looper thread holding apparatus for a sewing machine according to the invention comprises:

Thread hooking means having a thread hooking member for hooking a looper thread having a predetermined tension, the thread hooking member being disposed in the proximity of a moving path of vertically reciprocating needle, and for retracting the thread hooking member to a predetermined first refuge position to draw the looper thread toward the first refuge position;

Cutting and holding means for cutting the looper thread drawn toward the first refuge position by the thread hooking means, by the cooperation of a first surface of the thread hooking member and a cutting edge which is disposed in proximity of the first surface, and for holding the cut portion of the looper thread by the cooperation of a second other surface of the thread hooking member and a holding member which Is resiliently pressed against the second surface; and Means for effective, immediately after a subsequent sewing operation is started, retracting to a second refuge position separated from the first refuge position, to release the cut portion of the looper thread held by the cutting and holding means.

In the invention, the thread hooking member may comprise a thread hooking portion having a formed in a side edge thereof recess into which the looper thread can be received, and at least a region of the periphery of the recess which is on the side of the second surface , is beveled which reduces the surface area of the second surface which contacts the looper thread.

The method of holding a looper thread for a sewing machine according to the invention comprises the steps of:

Hooking a looper thread extending from a needle location by a thread hooking member;

Drawing the looper thread to a predetermined first refuge position separated from the needle location;

Cutting the looper thread by a cutting edge;

Holding the cut portion of the looper thread by a holding member; and releasing the held cut portion of the looper thread, immediately after a subsequent sewing operation is started.

According to the apparatus of the invention a looper thread extending from the vicinity of the moving path of the needle is hooked by the thread hooking member of the thread hooking means, and under this state the thread hooking member is retracted to the predetermined first refuge position, thereby drawing the hooked looper thread toward the first refuge position. The looper thread drawn toward the first refuge position is cut on the first surface of the thread hooking member by the cutting edge, and held on the second surface of the thread hooking member by the and holding mechanism. Immediately after the sewing operation is resumed, the releasing mechanism retracts to the second refuge position, and the held cut portion of the looper thread held by the thread hooking member and the holding member is released. This prevents the case from occurring in which, as described in conjunction with the prior art, the seam advances while the end of a looper thread is held by the cutting and holding means or the seam is formed under the state where the end of a looper thread is fastened. At the substantially same time with the start of the sewing operation, the looper thread is pulled into the seam by the tension acting on the looper thread, thereby preventing the end of the looper thread from extending from the starting portion of the seam.

According to the apparatus of the invention set forth at least a region of the surface that contacts the looper thread along the peripheral of the recess of the thread hooking portion is beveled. This reduces the contact area of the holding member which is resiliently pressed against the second surface. Therefore, the friction caused by the beveled periphery edge is reduced so that the looper thread that is resiliently sandwiched between the other surface and the holding member can be smoothly pulled out. Also in this configuration, when the sewing operation is started, the held cut portion of the looper thread can be surely released at the substantially same time with the start of the advance of the seam, thereby preventing the end of the looper thread from extending from the starting portion of the seam.

According to the method of the invention the looper thread is drawn to the predetermined first refuge position under the state where the looper thread is hooked by the thread hooking member, and is then cut by the cutting edge. The vicinity of the cut portion of the looper thread is held by the holding member. Immediately after the sewing operation is started, the cut portion of the looper thread is released. This release of the cut portion of the looper thread immediately after the start of the sewing operation prevents the seam from advancing while the end of the looper thread is kept held. Therefore, the case in the prior art where the end of the looper thread is extended and sewed in the sewn product does not occur. Instead, the end of the looper thread is pulled into the seam by the tension of the looper thread, thereby preventing the end of the looper thread from extending from the starting portion of the seam.

According to the apparatus of the invention the case is prevented from occurring in which, as described in conjunction with the prior art, the Seam advances while the end of a looper thread held by the cutting and holding means or the seam is formed under the state where the end of a looper thread is fastened. At the substantially same time with the start of the sewing operation, the looper thread is pulled into the seam by the tension acting on the looper thread. As a result, the end of the looper thread extending from the starting portion the seam can be made as short as possible, or the end of the looper thread is prevented from extending from the starting portion of the seam. In this way, it is possible to eliminate the need for conducting the thread end removal operation after the sewing operation.

According to the apparatus of the invention at least a portion of the region contacting with the looper thread in the periphery portion which is in the side of the second surface and surrounds the recess that is formed in the thread hooking portion is beveled. This decreases the contact area of the holding member which is resiliently pressed against the second surface. Therefore, the friction caused by the periphery portion is reduced so that the looper thread resiliently sandwiched between the other surface and the holding member can be smoothly pulled out. Also in this configuration, when the sewing operation is started, the cut portion of the looper thread can be surely released at the substantially same time with the start of the advance of the seam. As a result, the end of the looper thread extending from the starting portion of the seam can be made as short as possible, or the end of the looper thread is prevented from extending from the starting portion of the seam. Therefore, it is possible to eliminate the need conducting the thread end removal operation after the sewing operation.

According to the method of the invention the looper thread is drawn to the predetermined first refuge position under the state where the looper thread is hooked by the thread hooking member, and is then cut by the cutting edge. The vicinity of the cut portion of the looper thread is held by the holding member. Immediately after the sewing operation is started, the cut portion of the looper thread is released. This released of the cut portion of the looper thread immediately after the start of the sewing operation prevents the seam from advancing while the end of the looper thread is kept held, Therefore, the case in the prior art where the end of the looper thread is extended and sewed in the sewn product does not occur. Instead, the end of the looper thread is pulled into the seam by the tension of the looper thread. Therefore, it is possible to eliminate the need for conducting the thread end removal operation after the sewing operation.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
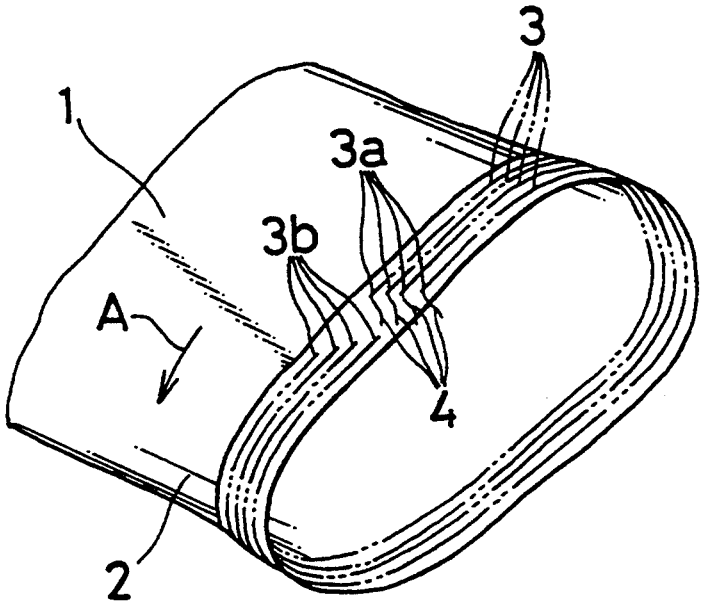
Fig. 1 Prior Art
FIG. 1 is a view illustrating the problem of the related art.

Now referring to the drawing, preferred embodiments of the invention are described below.

Figure 2:
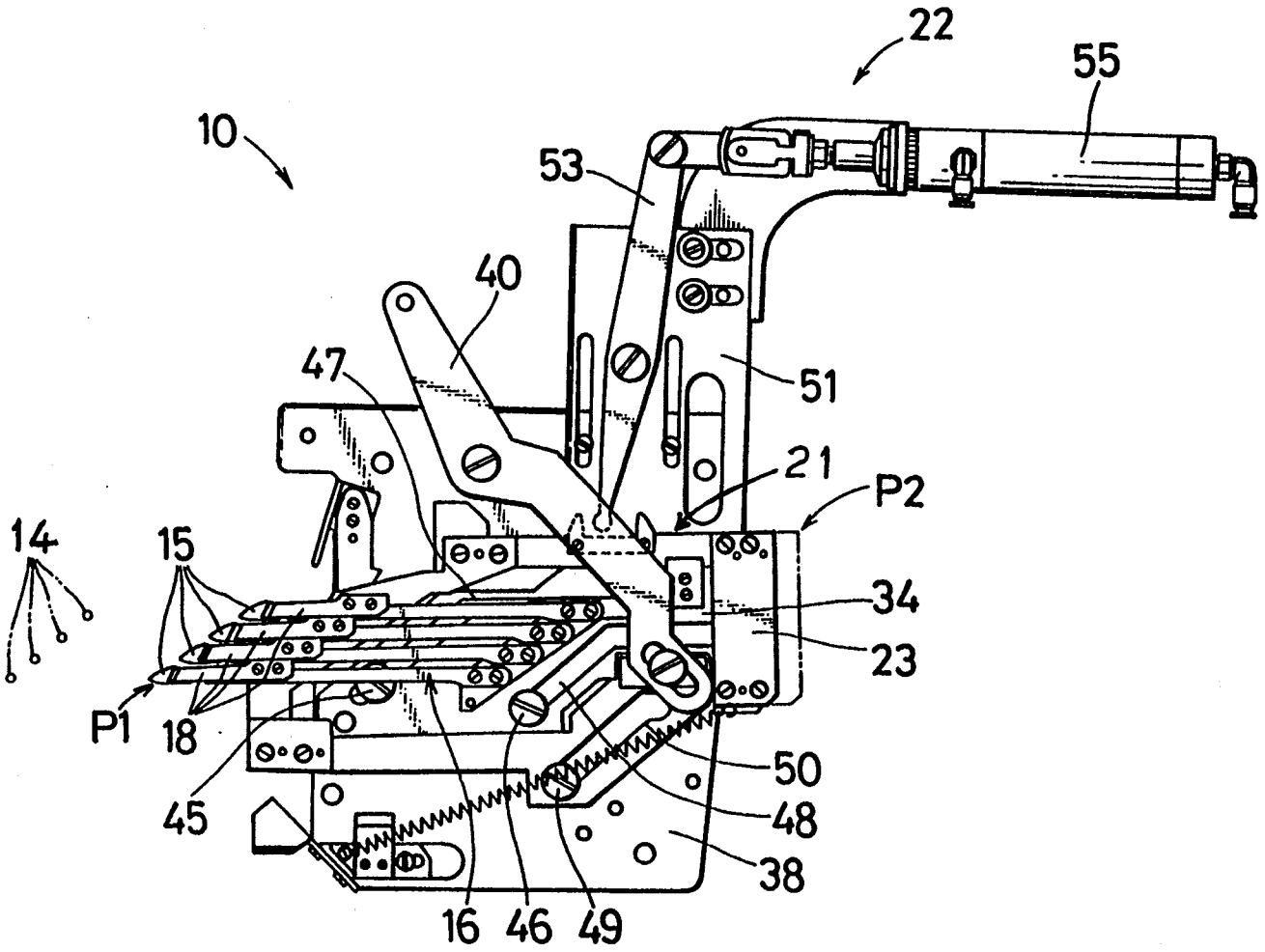
FIG. 2 is a plan view showing a looper thread holding apparatus 10 which is an embodiment of the invention.
Figure 3:
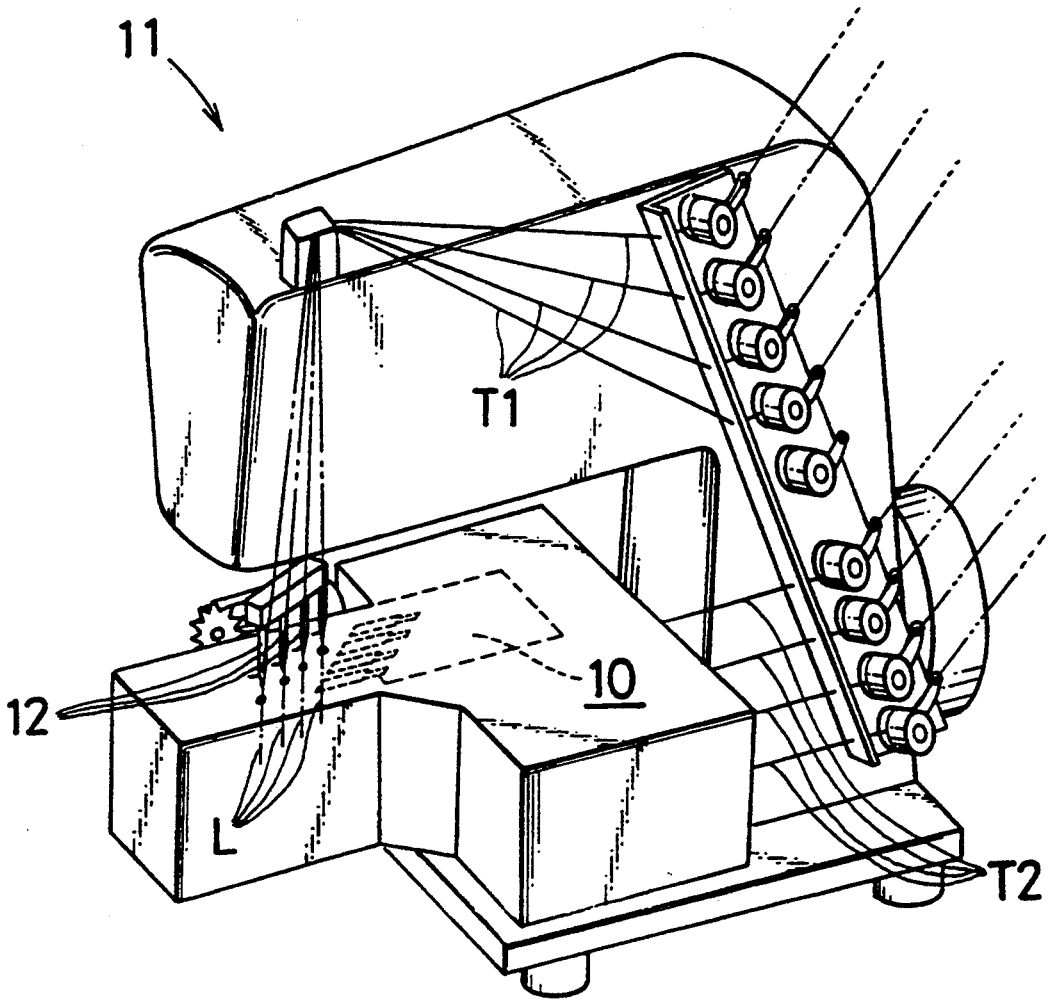
FIG. 3 is a perspective view of a looper sewing machine 11 which is provided with the looper thread holding apparatus 10.

FIG. 2 is a plan view showing a looper thread holding apparatus 10 which is an embodiment of the invention, and FIG. 3 is a perspective view of a looper sewing machine 11 which is provided with the looper thread holding apparatus 10. The looper sewing machine It comprises a plurality (in the embodiment, four) of needles 12 which vertically reciprocates along a vertical moving path L while needle threads T1 respectively pass through the needles 12. When the needles 12 are lowered together with the needle threads T1 and pass through needle drop points 14 formed In a machine bed 13, the needle threads T1 are caught by loopers (not shown) which are respectively disposed under the needle drop points 14. When the needles 12 are then raised, the needle threads TI are engaged with looper threads T2 supplied beneath the machine bed 13, thereby forming seams on sewn product such as clothes. In this way, circular seems are formed so that elastic braids or the like elongate between the seams, thereby completing the operation of fitting elastic braids.

Figure 4:
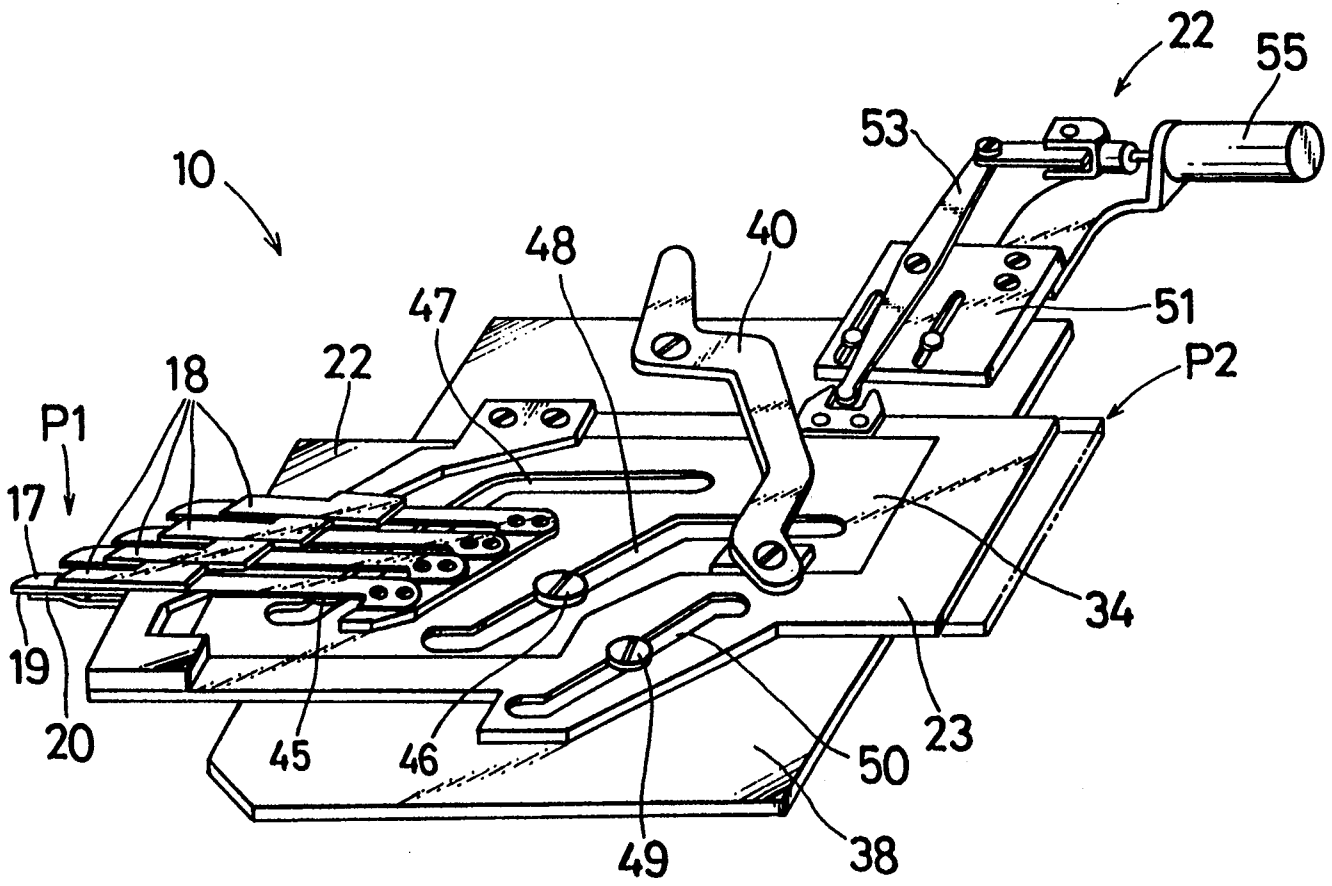
FIG. 4 is a perspective view shoving the looper thread holding apparatus 10 in a simplified manner.

Referring also to FIG. 4, the looper thread holding apparatus 10 disposed in the looper sewing machine 11 comprises as basic components thread hooking means 16, cutting and holding means 21, and release means 22. The thread hooking means 16 comprises four thread hooking members 15 each of which is disposed in proximity of the moving path L of the respective needle 12 and which hooks the looper thread T2 having a predetermined tension. The four thread hooking members 15 have the same configuration and operate in the same way. For the sake of simplicity, therefore, the description will be made with respect to only one of the thread hooking members 15 and the other components corresponding to this one thread hooking member. The thread hooking mechanisms 16 retracts the thread hooking member 15 to a predetermined first refuge position P1 shown in FIG. 2 to draw the looper thread T2 toward the first refuge position P1. The cutting and holding means 21 cuts the looper thread T2 drawn toward the first refuge position P1 by the thread hooking mechanisms 16, by the cooperation of a first surface 17 of the thread hooking members 15 and a cutting edge 18 which is disposed in proximity of the first surface 17. The cutting and holding mechanisms 21 holds the vicinity the cut portion of the looper thread T2 by the cooperation of the second surface 19 of the thread hooking member 15 and a holding member 20 which is resiliently pressed against the other surface 19. The release means 22 retracts to a second refuge position P2 separated from the first refuge position P1, to release the cut portion of the looper thread T2 held by the cutting and holding mechanisms 21.

Figure 5:
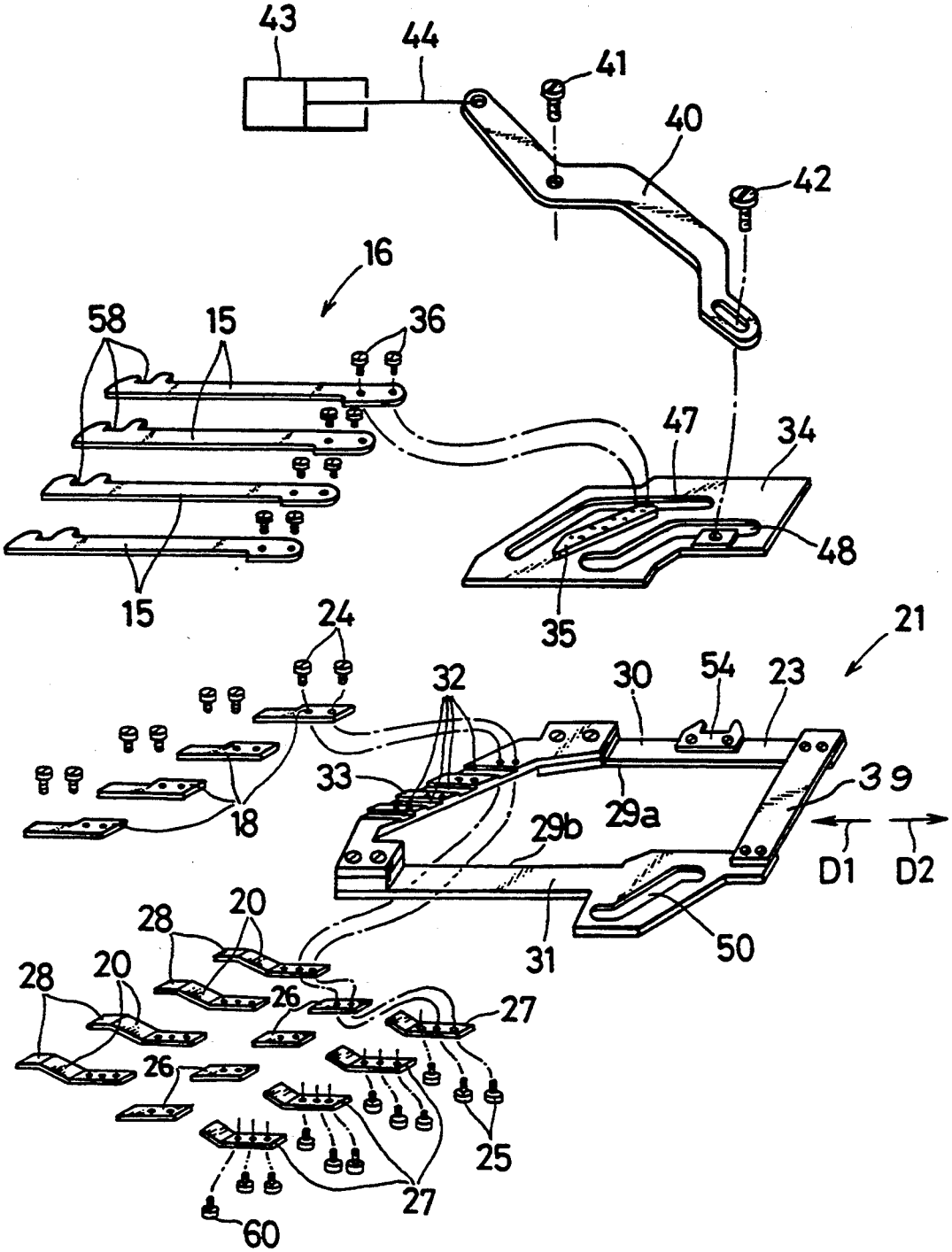
FIG. 5 is an exploded perspective view illustrating the configuration of thread hooking means 16 and cutting and holding means 21.

FIG. 5 is an exploded perspective view illustrating the configuration of the thread hooking mechanisms 16 and cutting and holding mechanisms 21. The cutting and holding ink mechanisms 21 comprises a first moving member 23 formed into a frame, the cutting edge 18 fastened by screws 24 in the first moving member 23, and the holding member 20 is fastened by screws 37 to the back face of the first moving member 23 to which the cutting edge 18 is fastened. A pressing piece 27 bent into a substantially L-like form is fixed onto the holding member 20 through a plate-like spacer 26. The bent front end of the pressing piece 27 presses against a contacting portion 28 of the holding member 20 so that the pressing force of the contacting portion 28 against the thread hooking member 15 is adjusted by the pressing force of the pressing piece 27. The holding member 20 and the pressing piece 27 may be formed by, for example, plate springs.

The first moving member 23 comprises long plate-like guiding members 30 and 31 respectively having guide faces **29*a* and 29*b* which face to each other to elongate in parallel, a connection member 39 which connects the ends of the guiding members 30 and 31 is the longitudinal direction, and a connecting member 39 which connects the other ends of the guiding members 30 and 31. On the connecting member 33, four guide grooves 32 idle which the thread hooking members 1*b* are respectively fitted to be guided therein are formed in parallel at equal spaces. Into the first moving member 23 having such a configuration, a generally plate-like second moving member 34 is fitted so as to be movably guided along the guide faces 29*a* and 29*b*** in a direction D1 in which the member approaches the moving path L and also in a direction D2 in which the member becomes more distant from the moving path L.

The second moving member 34 is provided with a mounting bracket 35 protruding from the upper face of the member. The thread hooking member 15 is fastened to the mounting bracket 35 by screws 36. The second moving member 34 to which the thread hooking member 15 is fastened is fitted into the first moving member 23 in such a manner that the thread hooking member 15 is fitted into the guide groove When the first moving member 34 moves, the thread hooking member 15 is guided in the direction of the arrow D1 or D2.

Figure 6:
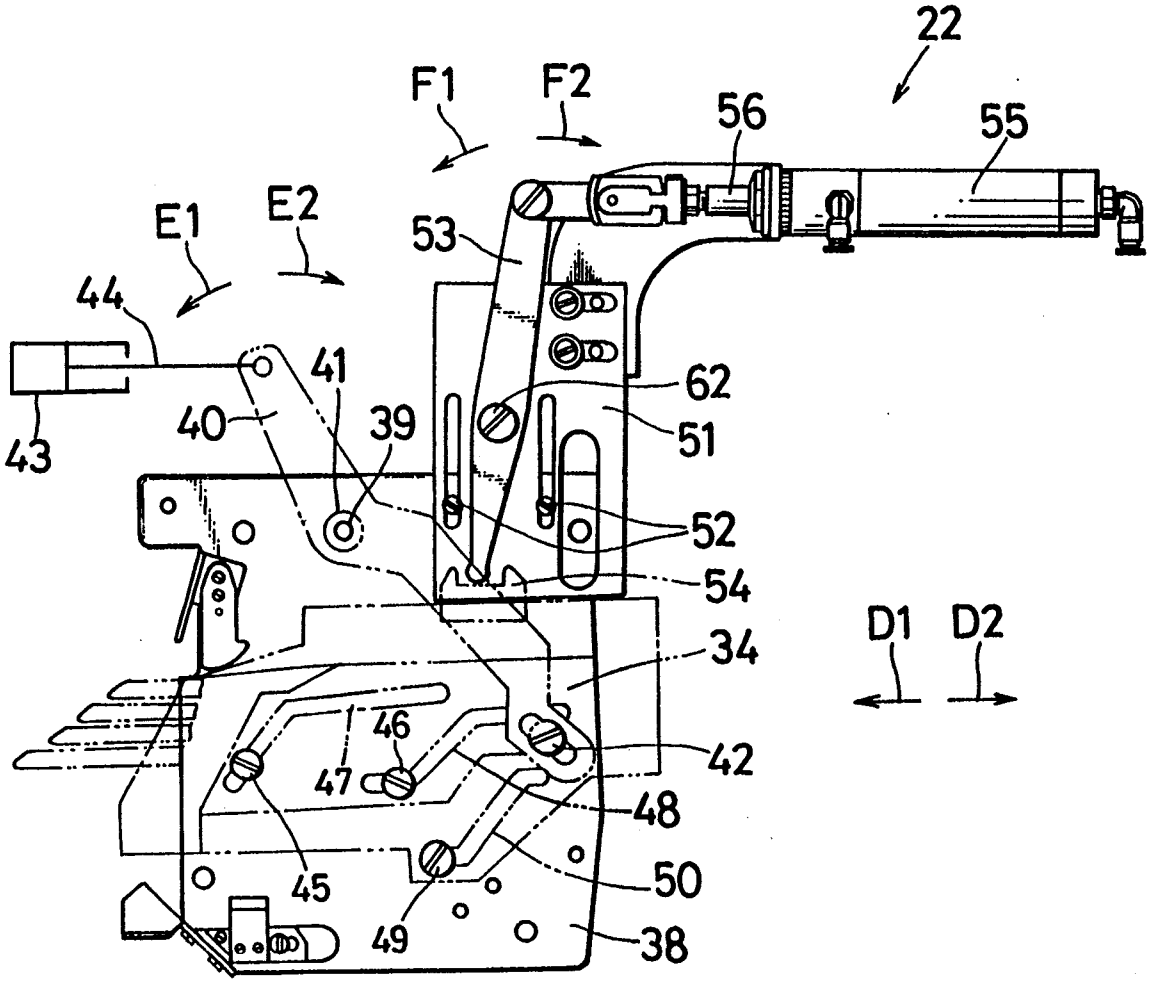
FIG. 6 is a plan view showing a base plate 38 and the vicinity thereof.

FIG. 6 is a plan view showing a base plate 38 and the vicinity thereof. The base plate 38 supports the first moving member 23 into which the second moving member 34 is fitted, in such a manner that the first moving member 23 can move in the directions of the arrows D1 and D2. The base plate 38 is fixed at a position which is beneath the machine bed 13 of the sewing machine 11 and in a plane substantially perpendicular to the moving path L. A shaft 41 such as a bolt which passes through a swing lever 40 shown in FIG. 5 is screwed in a tapped hole 39 formed on the base plate 38, so that the swing lever 40 can swing in the directions of arrows E1 and E2. One end of the swing lever 40 is connected to the second moving member 34 by a screw 42, and the other end of the swing lever 40 is connected to a piston rod 44 of a double acting cylinder 43. A pair of shafts 45 and 45 are screwed to the base plate 38. The shafts 45 and 46 are respectively fitted into long guide holes 47 and 48 formed in the second moving member :]4, so as to guide the second moving member 34. A shaft 49 is screwed to the base plate 38. The shaft 49 is fitted into a long guide hole 50 formed in the first moving member 23, so as to guide the first moving member 23.

A support member 51 is fastened to the base plate 38 by screws 52. A second swing lever 53 is supported by a shaft 62 on the support member 51 in such a manner that the swing lever 53 can swing in the directions of arrows FI and F2. One end of the swing lever 53 contacts with a contacting piece 54 fixed to the first moving member 23, so that the first moving member 23 is moved in the directions of the arrows D1 and D2 between the first and second refuge positions P1 and P2. The other end of the swing lever 53 is connected to a piston rod 56 of a double acting cylinder 55. When the piston rod 56 of the double acting cylinder 55 extends, the swing lever 53 is rotated about the shaft 62 in the direction of the arrow F1, whereby the first moving member 23 is moved in the direction of the arrow B1 to change its position from the first refuge position P1 to the second refuge position P2. During this process, the second moving member 34 is Inhibited from moving or kept staying at the first refuge Position P1, by the shafts 45 and 46 which are respectively positioned at one longitudinal ends of the long guide holes 47 and 48 as shown In FIG. 2. Therefore, with respect to the thread hooking member 15, the cutting edge 18 and the holding member 20 relatively retract in the direction of the arrow D2, thereby canceling the held state of the looper thread T2 which is fitted into a thread hooking recess of a thread hooking portion 57 formed at one longitudinal end of the thread hooking member 15. The double acting cylinder 55, the swing lever 53 and the contacting piece 54 constitute release mechanisms 63.

Figure 7:
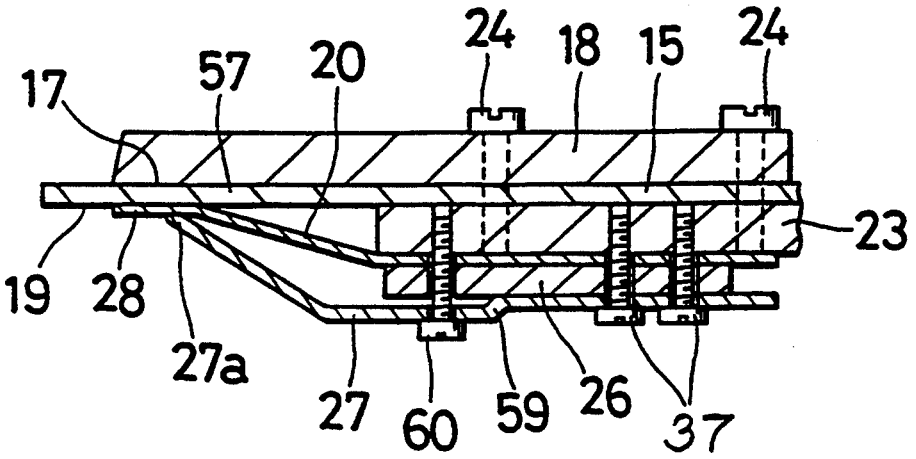
FIG. 7 it an enlarged section view of a holding member 20 and the vicinity thereof.

FIG. 7 is an enlarged section view of the vicinity of the holding member 20. The contacting portion 28 of the holding member 20 is formed so as to be substantially parallel with the second surface 19 of the thread hooking portion 57 of the thread hooking member 15. The lower face of the contacting portion 28 is pressed by the front end **27*a* of the pressing piece 27. The pressing piece 27 is so constructed that, under the state where it is attached to the first moving member 23 by the screws 25, the portion in the side of the front end 27*a* is separated from the spacer 26 by a bent portion 59 which is bent downward as viewed in FIG. 7, and that the pressing force exerted to the contacting portion 28 is adjusted by rotating an adjusting screw 60**.

Figure 8:
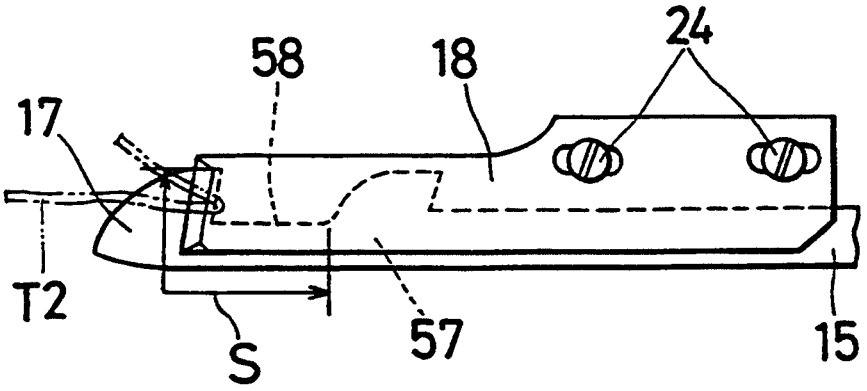
FIG. 8 is a plan view of the vicinity of a thread hooking portion 57 of a thread hooking member 15.
Figure 9:
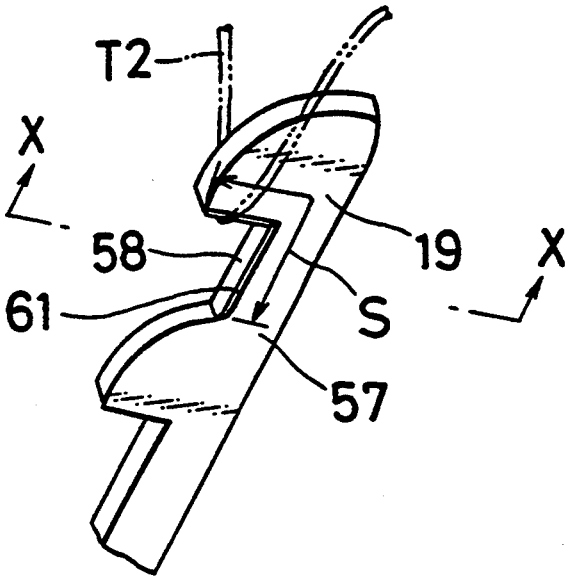
FIG. 9 is a perspective view looking up beneath the vicinity of the thread hooking portion 57.
Figure 10:
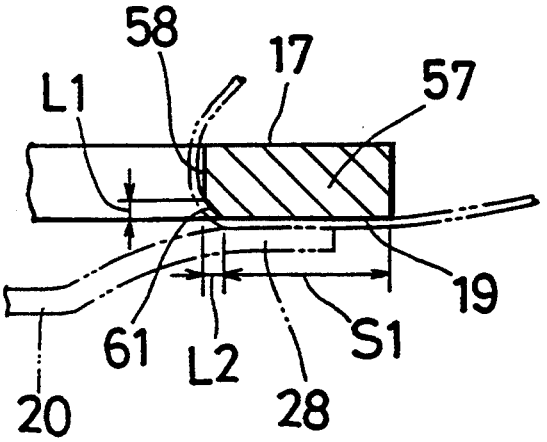
FIG. 10 is a section view taken along line X—X of FIG. 9.

FIG. 8 is a plan view of the vicinity taken in the cutting edge 18, and FIG. 9 is a perspective view of an isolated portion of the thread hooking mechanism including the thread hooking portion 57. The thread hooking portion 57 of the thread hooking member 15 has a recess 58 formed in a side edge. The edge of recess 58 is formed with a bevel 61 along its intersection with the second surface 19. Beveled edge 61 is formed in at least a region S of the periphery portion of the second surface 19 which surrounds the recess 58 and is in contact with the looper thread T2. The beveled edge 61 is inclined toward the first surface 17 when approaching the fitting recess 58. That is, as shown in FIG. 10, a portion of the region S is cut away by a distance L1 in the thickness direction of the thread hooking portion 57 and by a distance L2 in the width direction of the thread hooking portion 57. The distances L1 and L2 are about 1 mm. The formation of the beveled edge 61 reduces the size of region S1 which contact the looper thread T2 when it is sandwiched between the second surface 19 and the holding member 20, and allows the looper thread T2 to be guided by the beveled edge 51 during the movement of the looper thread T2. Therefore, fiber from which the looper thread T2 is formed is prevented from being locked between the second surface 19 and the holding member 20, whereby the looper thread can be released when desired.

In this configuration, the sewing operation is started under the state where the looper thread T2 has been cut by the cutting edge 18 and the cut portion is held by the holding member 20. Immediately after or 0 to 1.5 seconds after the start of the sewing operation, the double acting cylinder 85 is energized to extend the piston rod 56. This causes the swing lever 53 to be rotated about the shaft 62 in the direction of the arrow F1, whereby the first moving member 23 is moved in the direction of the arrow D2 to be positioned at the second refuge position P2, while the second moving member 34 is retained at the first refuge position PI. Therefore, the cut portion of the looper thread T2 that is being in the recess 58 and resiliently sandwiched between the contacting portion 28 of the holding member 20 and the second surface 19 of the thread hooking member 15 is released so that the cut portion of the looper thread is pulled into the seam with the operation of a thread take-up lever or the like, thereby preventing the end of the looper thread from extending from the starting portion of the seam. Experiments conducted by the inventor confirmed that the length of the looper thread extending from the starting portion of the seam can be shortened to 0 to 2 mm when the period from the start of the sewing operation to the A release of the cut portion of the looper thread is adequately adjusted in the range of 0 to 1.5 seconds. Accordingly, it is not necessary to manually trim away the end of the looper thread after completion of the sewing operation, thereby reducing the number of working steps and saving the labor. At a time of 1 to 5 seconds after the holding member 20 has been retracted to the third refuge position to release the looper thread, the holding member 20 is moved to the first refuge position P1, and this state is kept unchanged until the next sewing operation is started.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A looper thread holding apparatus for a sewing machine, comprising:

a thread cutting mechanism including a cutting edge;

a thread holding mechanism including a holding member;

thread hooking mechanism having a thread hooking member for hooking a looper thread having a predetermined tension and a first surface for cooperating with said thread cutting mechanism and a second surface for cooperating with said thread holding mechanism, the thread hooking member being disposed in proximity to the moving path of a vertically reciprocating needle, a moving member operatively connected to said thread hooking member for retracting the thread hooking member, after the looper thread has been hooked, to a predetermined first refuge position to draw the looper thread toward the first refuge position, said first refuge position being remote from the moving path of the vertically reciprocating needle;

said thread cutting mechanism functioning to cut the looper thread as it is drawn toward the first refuge position by the thread hooking mechanism, by the cooperation of said first surface of the thread hooking member and said cutting edge which is disposed in proximity of the first surface;

said thread holding mechanism being located in the vicinity of said cut portion of the looper thread and functioning to hold said cut portion by the cooperation of said second surface of the thread hooking member and said holding member which is resiliently pressed against said second surface; and a movement member for, immediately after a sewing operation is started, retracting said thread hooking mechanism to a second refuge position separated from the first refuge position, to release said cut portion of the looper thread held by the holding mechanism.

2. A looper thread holding apparatus for a sewing machine as claimed in claim 1, wherein the thread hooking member comprises a thread hooking portion having a recess formed therein into which the looper thread can be received, and at least a portion of the peripheral edge of the recess, adjacent said second surface, being beveled to prevent snagging of the looper thread and insure release of the cut portion at the appropriate time.

3. A method of holding the cut portion of a looper thread at the termination of a sewing operation, comprising steps of:

hooking a looper thread extending from a needle location by a thread hooking member;

drawing the looper thread to a predetermined first refuge position separated from the needle location;

cutting the looper thread by drawing it across a cutting edge;

holding said cut portion of the looper thread by a holding member; and releasing the cut portion of the looper thread, immediately after the subsequent sewing operation is started.

* * * * *